US006305931B1

(12) United States Patent
De Marchi et al.

(10) Patent No.: US 6,305,931 B1
(45) Date of Patent: Oct. 23, 2001

(54) ROTARY HEARTH FURNACE WITH LIGHTENED CONSTRUCTION

(75) Inventors: Giovanni De Marchi, Genoa; Francesco Perugi, Santa Margherita Ligure, both of (IT)

(73) Assignee: SMS Demag S.p.A. (IT)

( * ) Notice: Subject to any disclaimer, the term of this patent is extended or adjusted under 35 U.S.C. 154(b) by 0 days.

(21) Appl. No.: 09/589,120

(22) Filed: Jun. 8, 2000

(30) Foreign Application Priority Data

Jun. 9, 1999 (IT) ..... GE99A0065

(51) Int. Cl.[7] ..... F27B 9/16
(52) U.S. Cl. ..... 432/138; 414/154
(58) Field of Search ..... 432/138, 137, 432/124, 195; 414/149, 150, 154

(56) References Cited

U.S. PATENT DOCUMENTS 2,879,051 3/1959 Buckholdt .
3,410,543 11/1968 Scharbrough .
3,982,890 9/1976 Lovell .
4,602,904 * 7/1986 Jeffreys ..... 432/138

* cited by examiner

*Primary Examiner*—Jiping Lu
(74) *Attorney, Agent, or Firm*—Larson & Taylor, PLC

(57) ABSTRACT

A rotary hearth furnace, in particular for the treatment of minerals or oxidized materials, includes a toroidal chamber wherein the bottom wall, i.e., the hearth, rotates as to the rest of the chamber the hearth includes a refractory material layer supported on a frame which includes the tracks cooperating with the wheels, placed on the ground, for the sliding and/or driving of said hearth. The frame includes several girts radial as to the hearth, angularly equidistant from each other, and at least two circular sliding girders, positioned next to the outer and inner peripheral edge of said hearth. The sliding girders are in contact with the hearth sliding and/or driving wheels through the suitable tracks, and the wheels are angularly equidistant from each other with the same angular pitch of the radial girts.

2 Claims, 4 Drawing Sheets

ROTARY HEARTH FURNACE WITH LIGHTENED CONSTRUCTION

TECHNICAL FIELD OF THE INVENTION

The present invention refers to furnaces for the treatment of minerals or oxidized materials, and in particular refers to furnaces of the rotary hearth type.

BACKGROUND OF THE INVENTION

In such a way area called the furnaces including a toroidal chamber with the bottom wall rotating as to the rest of the chamber, the so said rotating hearth, being positioned several burners on the side walls and the ceiling wall of the furnace. The hearth, made of a thick layer of refractory material, is normally supported by a frame on which can be assembled the wheels cooperating with suitable tracks; alternatively, the frame has the circular tracks for the sliding and/or driving wheels of the hearth itself, placed on the ground.

The positioning on the ground of said wheels offers many advantages both from a practical point of view, such as the plant embodiment more easiness and the better maintenance possibilities, and from an economical point of view, bound substantially to the construction simplifications. Nevertheless, this kind of solution subjects the hearth refractory material layer to considerable stresses, which can cause even substantial damages.

SUMMARY OF THE INVENTION

Object of the present invention is then to embody a rotary hearth furnace where the hearth sliding and/or driving wheels can be placed on the ground without producing, for this reason, damages to the integrity of the refractory material layer forming the hearth itself.

Object of the present invention is then a rotary hearth furnace for the treatment of minerals or oxidized materials including a toroidal chamber with the bottom wall, said hearth, rotating as to the rest of the chamber, said hearth including a refractory material layer supported on a frame which includes the tracks cooperating with the wheels, placed on the ground, for the sliding and/or driving of said hearth; characterized in that said frame includes several girts radial as to said hearth, angularly equidistant from each other, and at least two circular sliding girders, positioned next to the outer and inner peripheral edge of said hearth, being said sliding girders in contact with the hearth sliding and/or driving wheels and being said wheels angularly equidistant from each other with the same angular pitch of said radial girts.

The sliding girders are made so that the de-formation which are subjected to during the rotation of the hearth is the same in spite of the different length of the span between two radial girts in the most outer circular girder and the most inner one. This result can be obtained through a different dimensioning of the girders, material being equal, or by using materials with mechanical strengths different from each other.

BRIEF DESCRIPTION OF THE DRAWINGS

Further advantages and features of the rotary hearth furnace according to the present invention will be obvious by the following description of an embodiment form of the same, made as not limitative description, with reference to the enclosed draw-ings, where.

DESCRIPTION OF THE PREFERRED EMBODIMENT OF THE INVENTION

Figure 1:
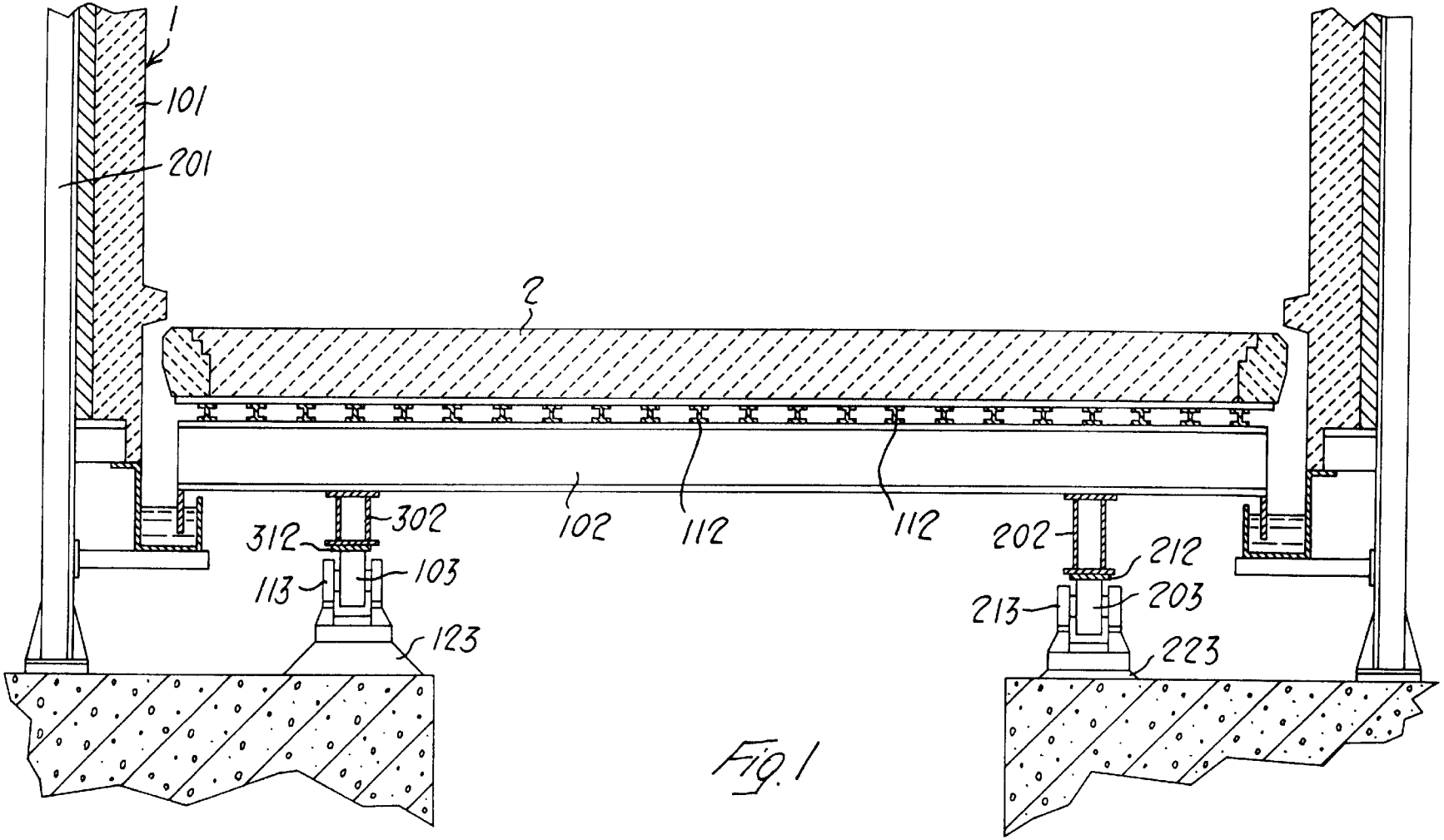
FIG. 1 is a cross section view of the furnace according to the present invention.

In FIG. 1 is shown in section the furnace according to the present invention; 1 indicates the furnace toroidal chamber, provided with the side walls 101 supported by the pillars 201. The bottom wall of said chamber is the rotating hearth 2, made of refractory material, supported, through the spacers 112, on the radial girts members 102. To the lower face of the girts 102 are connected the circular girders 202 and 302, respectively next to the outer peripheral edge and the inner peripheral edge of said hearth 2. The lower face of said girders is provided with the sliding track, respectively 212 and 312, for the sliding and/or driving wheels, respectively 203 and 303. These wheels, in the case shown idle, area journalled on the forks 113 and 213, positioned on respective bases 123 and 223.

Figure 2:
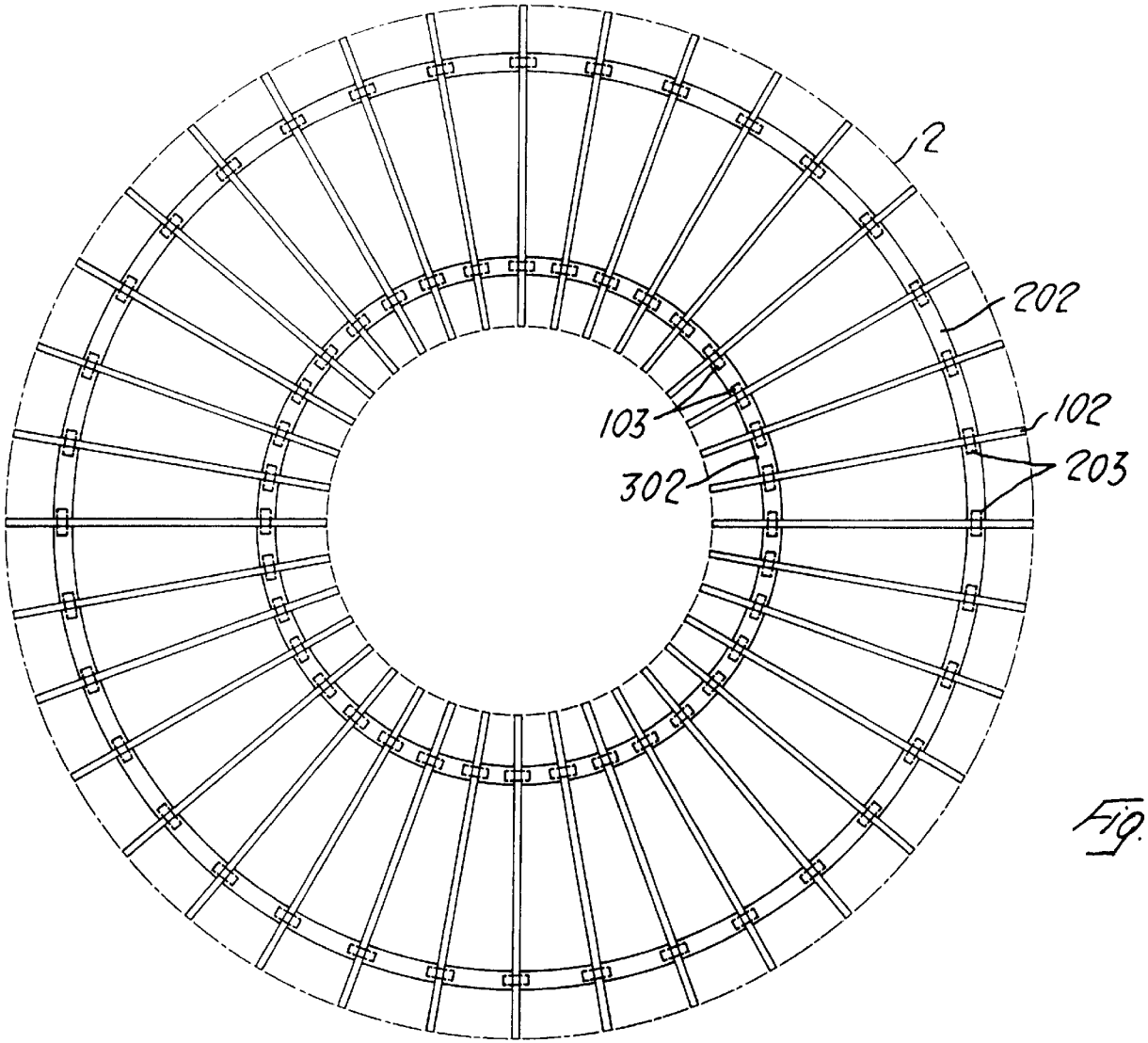
FIG. 2 is a schematic plain view of the hearth of the furnace according to the present invention.

In FIG. 2 is schematically shown the rotary hearth 2 of the furnace according to the invention. As shown, the radial girts 102 are angularly equidistant from each other. Moreover, also the wheels 103 and 203 are placed along the tracks of the sliding circulars girders 302, 202 angularly equidistant from each other, and so to have the same angular pitch of the radial girts 102.

Figure 3:
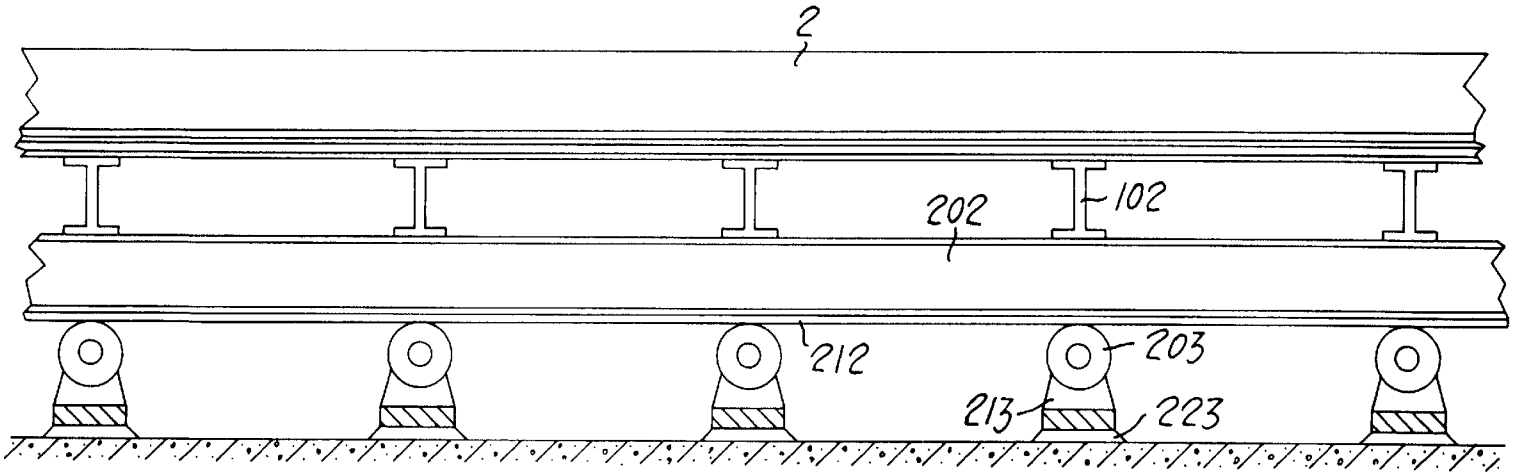
FIG. 3 is a section view according to the line III—III of FIG. 1.
Figure 4:
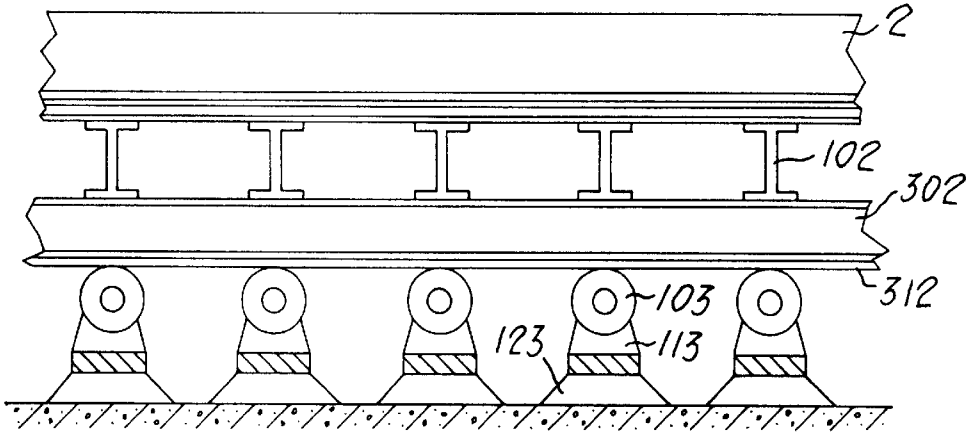
FIG. 4 is a section view according to the line VI—VI of FIG. 1.

In FIG. 3 the hearth of the furnace according to the present invention is shown in section along the line Ill—Ill of FIG. 1; to same parts correspond same numbers. From the Figures is clear that the girts 102 and the wheels 203 are equivalent in number and angular distance; in this case the wheels are positioned in connection with the maximum resistance points of the girder 202, it is to say in connection with the girts 102. In FIG. 4 is shown the absolutely analogous situation occurring for the wheels 103 cooperating with the girder 302 track 312. It is to notice in this case the different height of the forks 113 bases 123, brought about by the smaller section of the girder 302 as to the girder 202 of FIG. 3.

Figure 5:
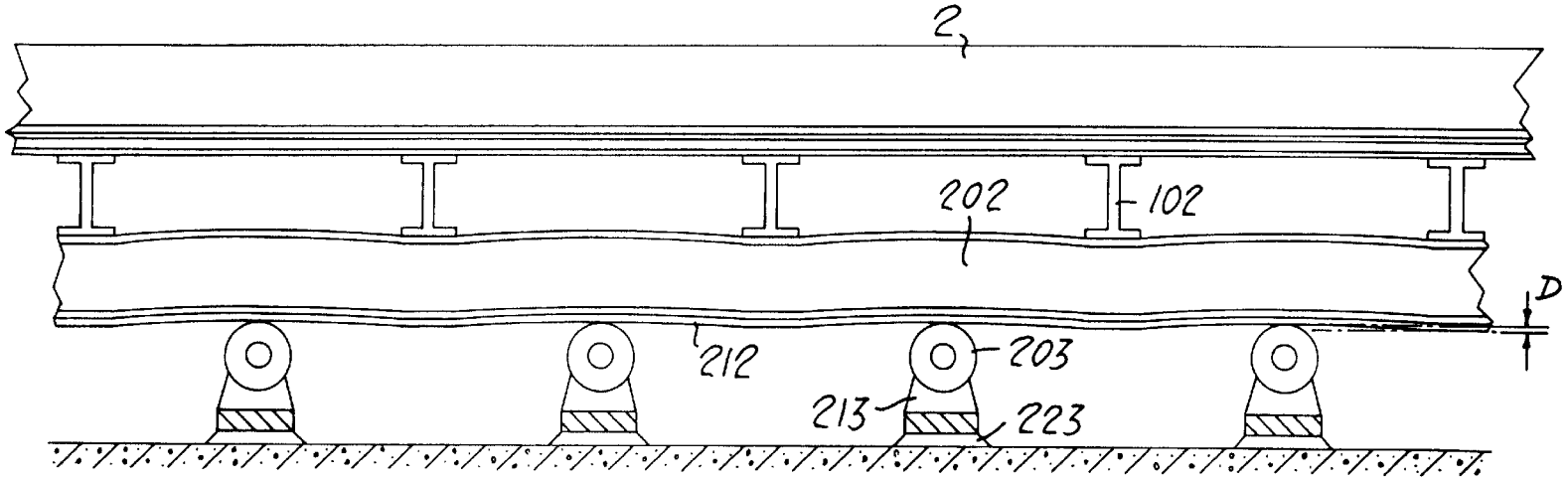
FIG. 5 is a view analogous to that of FIG. 3, with the sliding wheels and girder in a changed position.
Figure 6:
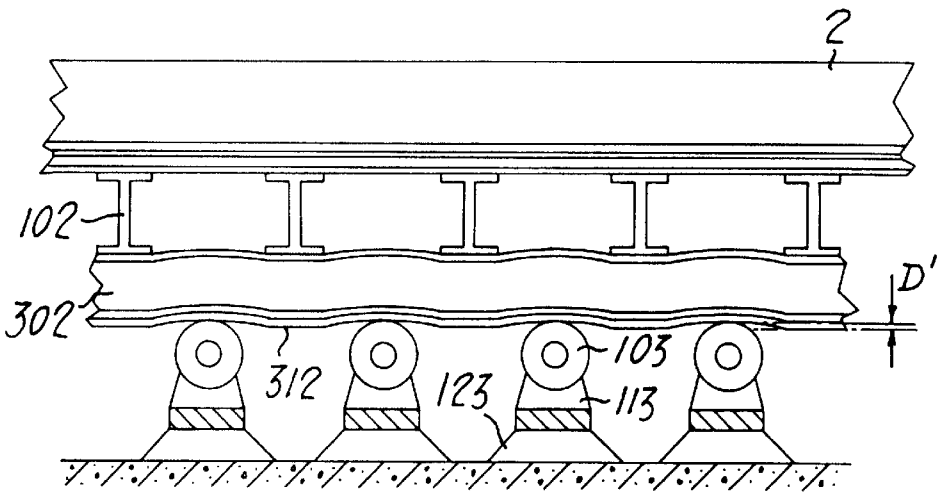
FIG. 6 is a view analogous to that of FIG. 3, with the sliding wheels and girder in a changed position.

In FIGS. 5 and 6 are shown the same parts of FIG. 3 and 4, during another stage of rotation of the hearth. In this situation each wheel is at the center of its girder 202 or 302 span between two girts 102. In the girder 201 of FIG. 5 takes place a deformation indicated with D. The deformation which the girder 302 of FIG. 6 is subjected to, said D', proves to be of the same extent of the deformation D of the girder 202.

The working of the furnace according to the present invention will be obvious by what follows. It has been previously mentioned the advantages following the placing of the sliding and/or driving wheels on the ground as to the coupling of the same ones with the frame structure of the hearth. Nevertheless such advantages can be partially cancelled if compared to the damages caused to the refractory material layer of the hearth by the changing loads on the supporting structure. According to the present invention this problem is solved placing the wheels destined to cooperate with the tracks 312, 212 of the circular girders 302 and 202 angularly equidistant with an angular pitch analogous to that of the radial girts 102 which together with said girders 202, 302 form the supporting frame of the hearth 2.

In fact, in this way, it will be an homogeneous distribution of the changing in the mechanical resistance of the supporting frame, and then the hearth will not be subjected to deformations. As it is clear from FIGS. 5 and 6, the maximum deformation of the girder 202 and 302 single spans as to the running along the tracks 212 and 312 of the wheels 203 and 103 will be simultaneous, causing a slight alternative periodical shifting of the hearth in the direction perpendicular to plane of the same, which can be even better exploited with profit for the production. For instance this shifting combined with the presence of mixing means of the layer of material laid out on the hearth will improve the mixing conditions.

Naturally, to reduce to the minimum the deformation effects on the hearth 2, it is necessary that the two circular sliding girders 202 and 302 are structured in a different way. In fact, the girder 202 has a smaller circumference and the single spans between one girt 102 and the other cover an arc which is considerably smaller than the analogous spans of the girder 202. It is clear that to obtain the same deformation, it is to say in order that D =D', the girder 302 must have a mechanical resistance smaller then that of the girder 202. This can be obtained in the way shown in FIGS. 1, 4 and 6 it is to say by realizing the girder 302 with a section smaller then that of the girder 202. This contrivance naturally requires the adjustment of the wheels 103 forks 113 bases 123, which have to be of greater sizes to ensure the correct sliding of the hearth 2.

The same result is, in principle, obtainable both by changing the thickness of the metal sheet of the girder 302 as to that of the metal sheet of the girder 202, and 20 by making the two girders with different materials with the suitable mechanical properties allowing to produce the same deformation in both girders. It can be generally asserted that the mechanical strength of the circular girders 202, 302 has to be substantially proportional to 25 the length of their circumference. In the case shown as an example, the girder 202 has a section approximately double as to the girder 302, being its circumference approximately double as to that of said girder 302.

The so contrived furnace allows then to use the rotation system with the wheels on the ground, reducing the stress on the refractory material of the hearth to the same level of the systems providing the wheels journalled on the frame. Moreover, the solution according to the invention proves to be even easier from a construction point of view and then economically convenient.

What we claim is:

1. A rotary hearth furnace for treatment of minerals, including a toroidal chamber wherein a bottom wall comprises a hearth which rotates relative to the chamber, said hearth including a refractory material layer supported on a frame which includes tracks cooperating with wheels, placed on the ground, for the sliding or driving of said hearth, said frame including several girts arranged radially as to said hearth and angularly equidistant from each other, and at least two circular sliding girders positioned next to outer and inner peripheral edges of said hearth, said sliding girders in contact with the hearth wheels through the tracks, the sliding girder positioned next to the outer peripheral edge of the hearth having an inertia moment greater than that of the sliding girder provided next to the inner peripheral edge, each sliding girder being tubular with a rectangular cross section and all girders comprising the same material, the walls of the sliding girders positioned next to the outer peripheral edge of the hearth having a thickness substantially double the thickness of the sliding girders provided next to the inner peripheral edge, said sliding guides having a mechanical strength substantially proportional to the length of their circumference, and said wheels being angularly equidistant from each other with the same angular pitch as that of said radial girts.

2. A furnace according to claim 1, wherein at least one of the girders comprises a composite material.

* * * * *